US005709562A

United States Patent [19]

Kourimsky

[11] Patent Number: 5,709,562

[45] Date of Patent: Jan. 20, 1998

[54] ZERO INSERTION FORCE CONNECTOR WITH WIPING ACTION

[75] Inventor: Fritz Josef Alois Kourimsky, Bensheim, Germany

[73] Assignee: The Whitaker Corporation, Wilmington, Del.

[21] Appl. No.: 626,881

[22] Filed: Apr. 3, 1996

[30] Foreign Application Priority Data

Apr. 28, 1995 [GB] United Kingdom ..... 9508690

[51] Int. Cl.[6] ..... H01R 11/22

[52] U.S. Cl. ..... 439/267

[58] Field of Search ..... 439/267, 268, 439/260

[56] References Cited

U.S. PATENT DOCUMENTS 4,303,294 12/1981 Hamsher, Jr. et al. ..... 439/267

4,553,803 11/1985 Lapraik et al. ..... 439/267

*Primary Examiner*—Khiem Nguyen

*Assistant Examiner*—Yong Ki Kim

*Attorney, Agent, or Firm*—Driscoll Nina

[57] ABSTRACT

A sealed ZIF connector for mating to a complementary connector with an internal PCB is for use with non-gold-plated terminals for a cost effective design. Such a connector may be for use in an automobile, for connection to a motor management electronics module. The connector is provided with a pivotable camming member having an oval camming surface positioned between contact arms of the terminals. In the pre-mated condition the camming surface spreads the terminal contact arms apart and the connectors can be coupled until the end of the PCB is almost against the camming surface. Upon rotation of the camming mechanism, the cam releases the contacts which bias against the PCB, whereby the cam subsequently abuts the end of the PCB to slightly separate the connectors. Separation of the connectors causes a wiping action between the contacts and the PCB to clean the surfaces from oxidation layers. The latter thus allows use of tin plated contacts for ZIF connectors.

9 Claims, 4 Drawing Sheets

ZERO INSERTION FORCE CONNECTOR WITH WIPING ACTION

BACKGROUND OF THE INVENTION

1. Field of the Invention

This invention relates to a connector having a mechanism for reducing contact mating forces and also providing a wiping action of mating contact surfaces, in particular for use with contacts that are not plated with a non-oxidizing material.

2. Description of the Prior Art

Zero insertion force (ZIF) connectors typically comprise a mechanism for biasing resilient contacts of a connector away from their final mated position, such that complementary connectors can be coupled without mating terminals exerting frictional or obstructional forces against each other. Once the connectors are coupled, the means for biasing the terminals apart is released, and the mating terminals are brought into electrical connection with each other. Such connectors are often provided where there are a large number of terminals and therefore a potentially high mating force, or where it is desirable to have ease of coupling.

The problem of many conventional systems is that when terminals are brought into contact with each other, there is no wiping action between the contacts. For this reason, such connectors have gold-plated contacts to prevent oxidizing layers forming on the contact surfaces. In the case of a tin-plated contact surface, for example, it would be necessary to have a wiping action in order to rub off the oxidizing layer at the contact surface. Oxidizing layers typically have high electrical resistance and therefore deteriorate the quality of electrical contact.

SUMMARY OF THE INVENTION

It is therefore an object of this invention to provide a ZIF connector having terminals with contact surfaces that are oxidizable, such connector nevertheless providing reliable contact.

It is an object of this invention to provide a ZIF connector having a mechanism for biasing apart contacts and then bringing them in electrical connection with mating contacts, such mechanism further producing a wiping effect between the mating contact surfaces.

It is an object of this invention to provide a low-cost, sealed ZIF connector for use in harsh environmental conditions such as in automotive applications.

Objects of this invention have been achieved by providing a connector comprising a housing and a plurality of electrical terminals having contact surfaces resiliently biasable away from their final mated condition so as to prevent rubbing against contact surfaces of a mating connector during coupling, the biasing means comprising a camming surface against which a mating end of the complementary connector abuts in a first, fully inserted position, wherein the camming surface is movable to a fully coupled position that releases the resilient contacts for electrical connection to the complementary connector, and also shifts the mating connectors relative to each other by way of this abutment, such that there is a wiping action between mating contact surfaces.

In an advantageous embodiment the camming member is rotatably movable, and actuation thereof can be made by a rotatable lever projecting beyond an outer surface of the connector housing. Such a lever could comprise wing portions that engage in a slot of an outer wall of the complementary connector when the lever is in the condition for ZIF, the wings engaging shoulders within the complementary connector wall when in the mated position in order to lock the coupled connectors together. In a longitudinal connector embodiment with two rows of contacts for connection to either side of a printed circuit board (PCB) of the complementary connector, the camming means could be advantageously positioned between the rows of contacts. For sealing the connector, the rotatable camming means could be positioned in supports provided with O-ring seals.

BRIEF DESCRIPTION OF THE DRAWINGS

FIG. 3 is a cross-sectional view through lines 3—3 also loaded with terminals and coupled to a complementary connector but with a cam in a board receiving position;

DETAILED DESCRIPTION OF THE PREFERRED EMBODIMENT

Figure 1:
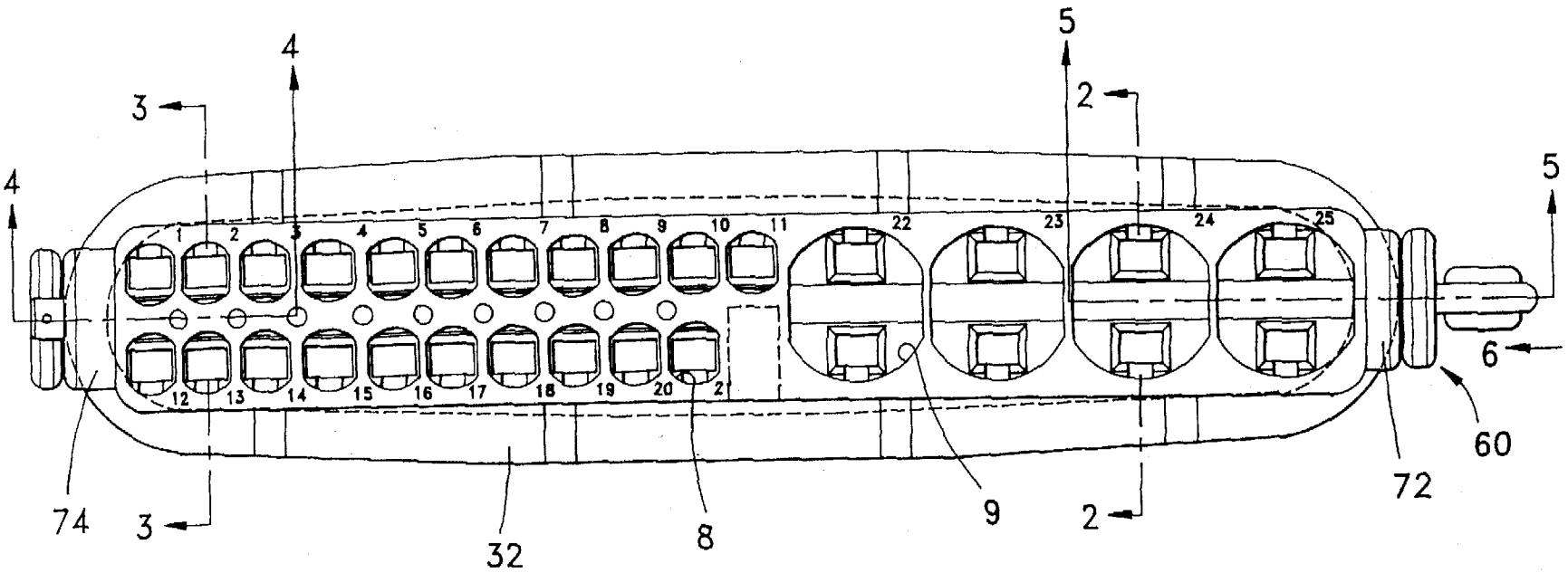
FIG. 1 is a view of a terminal receiving end of a connector according to this invention.
Figure 7:
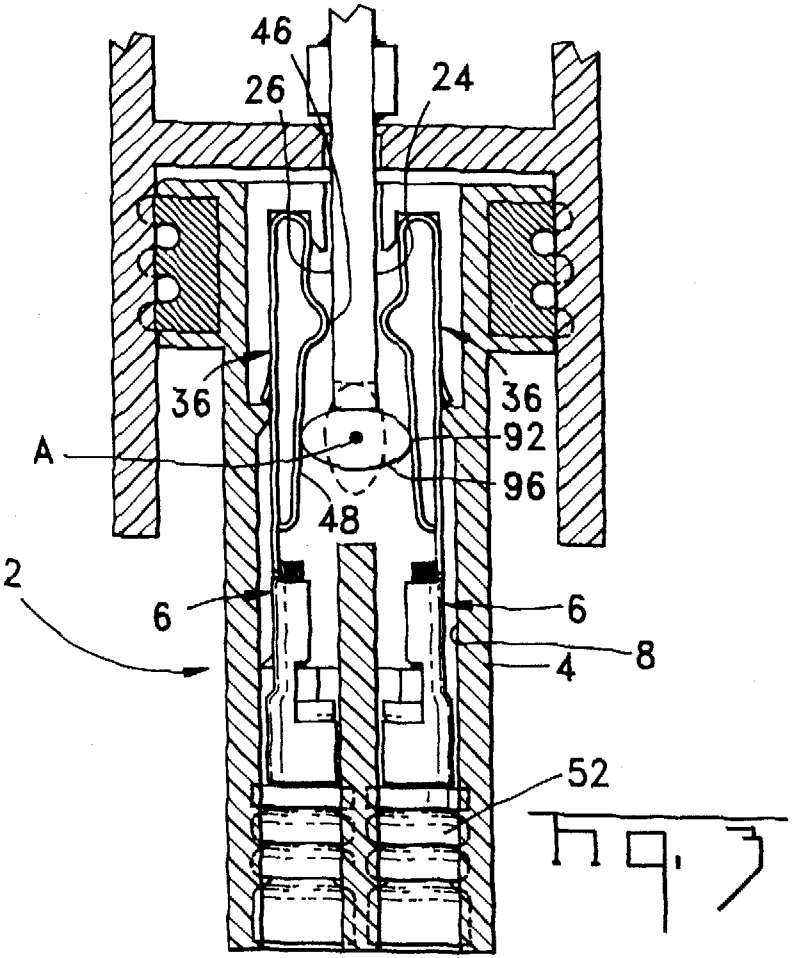
FIGS. 7 and 8 are views of a terminal of the connector of FIGS. 1–6.
Figure 2:
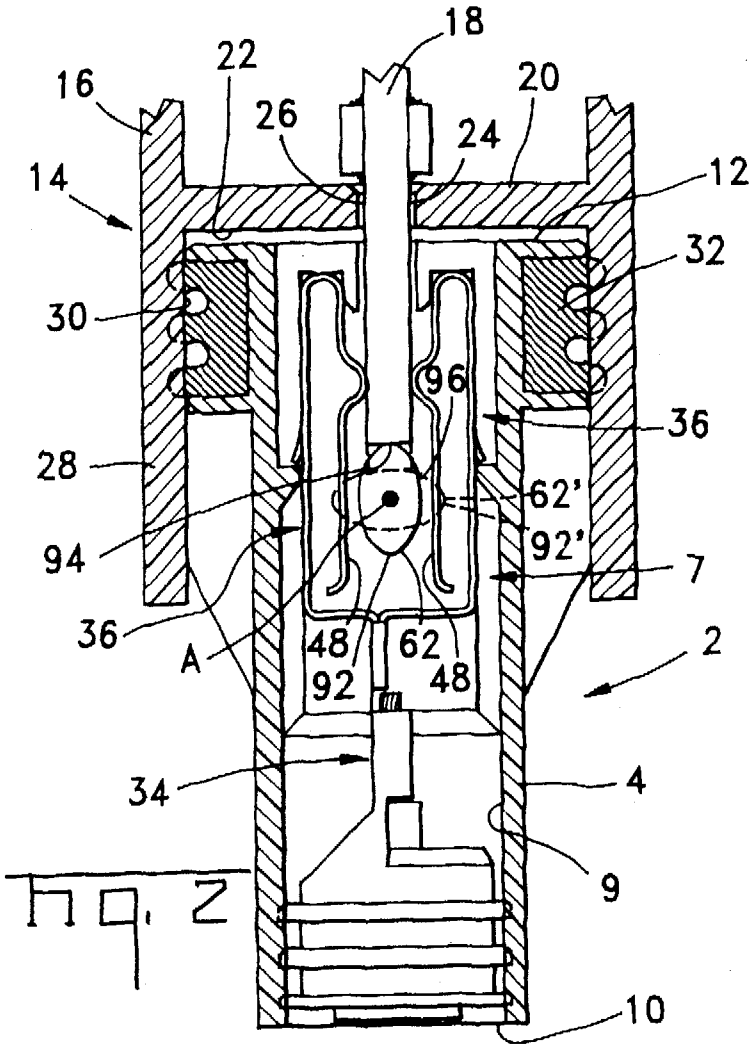
FIG. 2 is a cross-sectional view through lines 2—2 of FIG. 1, further assembled to terminals and coupled to a complementary connector.
Figure 5:
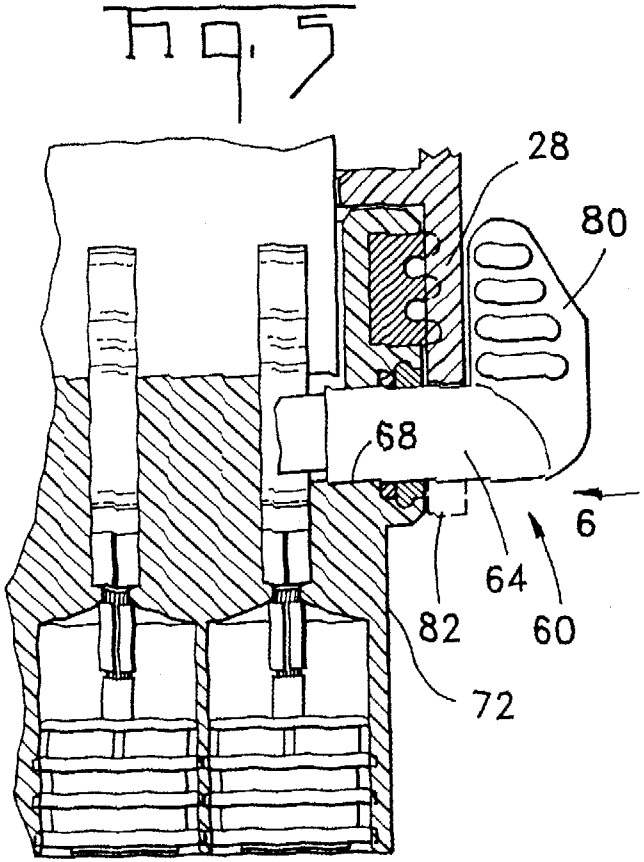
FIG. 5 is a cross-sectional view through lines 5—5 of FIG. 2.

Referring to FIGS. 1–3, a ZIF connector 2 comprises an insulative housing 4 and a plurality of terminals 6,7 mounted in cavities 8,9 extending through the housing from a terminal receiving end 10 to a mating end 12. The connector 2 is matable to a complementary connector 14 comprising a housing 16 and a PCB 18 extending axially through a front wall 20 of the housing 16. The front wall 20 defines a mating face 22 positioned proximate the mating face 12 when the connectors are coupled together. Electrical terminals of the PCB 18 comprise conductive circuit traces arranged on either side 24,26 of the PCB. The complementary connector housing 16 further comprises a shroud 28 extending beyond the mating face 22 and having an inner surface 30 that is a sealing surface cooperable with a peripheral elastomeric sealing member 32 mounted around the housing 4 of the connector 2.

Referring to FIGS. 1–3, 7 and 8, the electrical terminals 6 are stamped and formed from sheet metal and comprise a connection section 34 for connection to a conducting wire, and a contact section 36 for contacting the terminals of the complementary connector 14. The contact section 36 comprises a substantially planar base strip 38 extending from the connection section 34 to a mating end 40, where the strip is then reversely folded through a U-bend to form a resilient contact arm 42 that extends to a free end 44 proximate the connection section 34. The resilient contact arm 42 comprises an outwardly protruding contact surface 46, and a camming surface 48 between the contact surface and the free end 44 for engaging a camming member to inwardly bias the arm 42 towards the base strip 38. At the free end 44 is an inwardly bent tab 50 for abutting the base strip 38 to limit inward biasing of the contact arm 42, in order to prevent over-stressing thereof.

As shown in FIG. 3, two rows of terminals 6 are mounted in mirror-image disposition for contacting terminals on either side of the PCB 18. Each of the terminals 6 have an annular elastomeric sealing member 52 assembled thereto at the connection end for providing sealing between the conducting wire and terminal receiving cavities 8.

Terminal 7 is slightly different in configuration to terminal 6, in that there are two contacting sections 36 in mirror-image disposition for contacting either side of the PCB 18, that are integrally connected to a single connection section 34 as shown in FIG. 2. Terminal 7 thus provides double the electrical connection to the PCB and may therefore be used for higher current requirements than those of the terminals 6.

Referring to FIGS. 1–6, the connector 2 further comprises a camming mechanism 60 that is positioned centrally between the two rows of contacting sections 36, adjacent the terminal camming surface 48. The camming mechanism 60 comprises a camming section 62 that is pivotly supported on either end 64,66 in cavities 68,70 respectively, extending through opposed longitudinal ends 72,74 respectively of the housing 4. Grooves 76 formed around the cavity 70 support elastomeric O-ring seals 78 that seal between the housing 4 and the camming mechanism 60. Extending from one of the supports 64 is a lever handle 80 for manually pivoting the camming mechanism 60.

Figure 6:
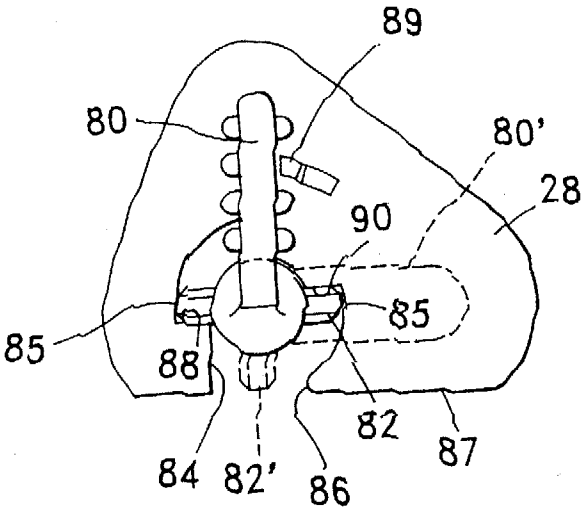
FIG. 6 is a partial view in the direction of arrow 6 of FIG. 5.
Figure 4:
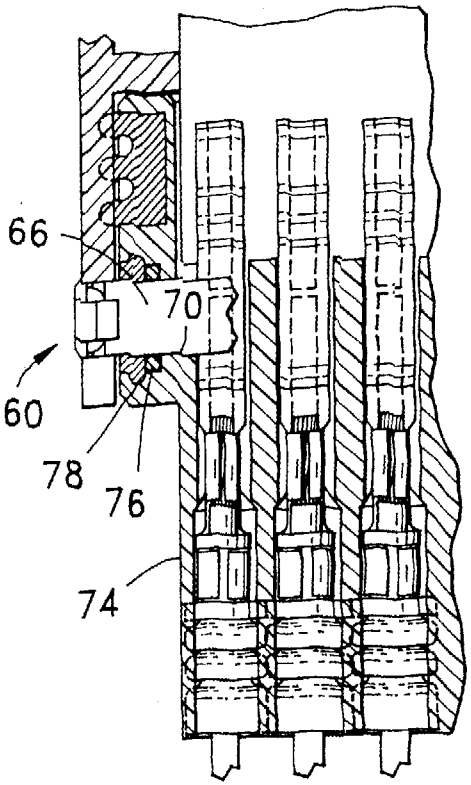
FIG. 4 is a cross-sectional view through lines 4—4 of FIG. 1.
Figure 7:
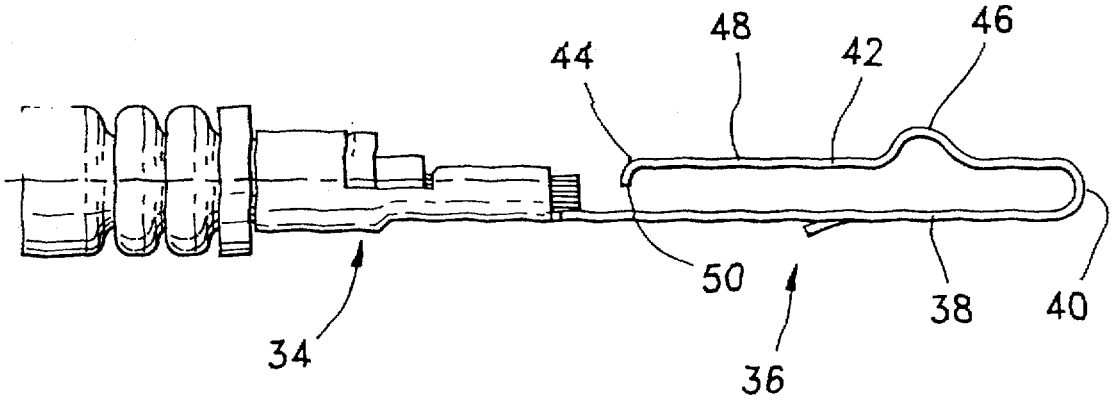
Figure 8:
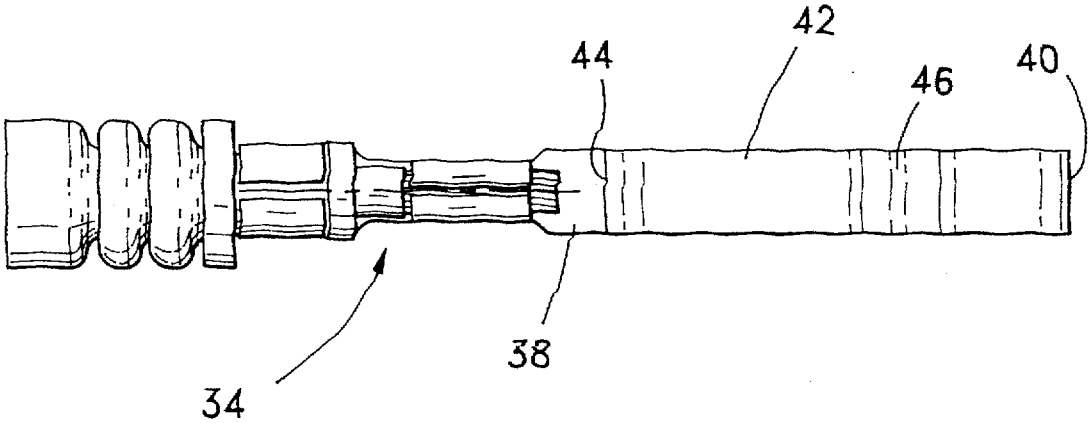

Referring to FIG. 6, wing members 82 extend in opposed directions from either side of the support portion 64, the wing members being positioned outside of the housing 4 and extending beyond the diameter of the support cavity 68. The shroud 28 of the complementary connector housing 16 comprises a cutout 84 that receives the camming mechanism support portion 64 and wing members 82 therethrough. The cutout 84 extends to a mouth portion 86 at an end 87 of the shroud 28. The mouth portion 86 has a width less than the width extending between opposed ends 85 of the wing members 88 such that in the fully locked position as shown in FIG. 6, the connectors cannot be coupled due to abutment of the wing members 82 with the shroud mating end 87.

In the mated condition as shown in FIG. 6, the lever handle 80 is retained in the vertical position (when looking at FIG. 6) by a resilient latching protrusion 89 integrally moulded with the complementary connector 28. Clockwise rotation of the camming mechanism 60 is prevented by abutment of the wing members 82 with shoulders 88,90 of the cutout 84. Clockwise movement is prevented by the latching protrusion 89.

In the pre-mated condition, the lever handle 80 is rotated by 90° in the clockwise direction as indicated by the dotted line 80' shown in FIG. 6. The wing members 82' are in the vertical position and can thus pass through the mouth 86 of the cutout 84 for coupling of the connectors 2,14.

Referring to FIG. 2, the camming section 62 is shown in the mated condition. The camming section 62 has an oblong shape (in this case substantially ellipticle) whereby in the mated position the long axis extends in the axial direction (connector coupling direction) such that the resilient contact arms 42 of the terminals are free to bias against the PCB 18. The camming section has a retracted camming surface 96 close to a pivot axis A of the camming mechanism 60, and a longitudinal camming surface 92 distant from the pivot axis A. In the pre-mated position as shown in FIG. 3, the camming section 62 is rotated by 90° such that the longitudinal camming surfaces 92 abut the resilient arm camming surface 48 to bias the contact surfaces 46 away from the PCB surfaces 24,26. In the pre-mated condition, the connector 2 can thus be coupled to the connector 14 without frictional contact between the contact surface 46 of the terminals and the PCB surfaces 24,26. Coupling is effectuated until a mating end 94 of the PCB 18 is proximate the retracted camming surface 96. In this position, the mating faces 12,22 of the connectors 2,14 respectively, substantially abut each other.

The lever handle 80 can then be rotated by 90° from the position 80' to the position 80 as shown in FIG. 6, whereby the camming portion rotates from the position 62' to the position 62 as shown in FIG. 2. The longitudinal camming surfaces 92' disengage from the terminal camming surfaces 48 thereby allowing the contact surfaces 46 to engage the PCB. The longitudinal camming surface 96 subsequently engages the PCB end 94 thereby pushing the connectors 2 and 14 away from each other. This relative movement between the connectors causes wiping of the contact surfaces 46 against the PCB circuit traces. Oxidation layers on the contact surfaces are thus broken and rubbed away to ensure a good electrical contact. The latter thus enables the contacts to be plated with oxidizing materials such as tin, rather than gold, for a more cost-effective design.

The pivotable camming member 16 and camming surface 62 enable large camming forces to be transmitted for the wiping action, with relatively little force required at the lever 80. Furthermore, rotation of the lever also securely locks the connectors 2,14 together. The pivotable camming member is also relatively easy to seal by means of the O-ring seals and its position in the connector 2 allows effective sealing between the connectors 2 and 14 by means of the annular sealing member 32. The simple design of the terminals makes them both cost-effective and reliable. For higher currents, a unitary stamped and formed terminal can be provided that engages both sides of the PCB.

Advantageously therefore, a cost-effective ZIF connector is provided for use with non-gold-plated terminals due to the wiping action effectuated by the ZIF camming mechanism. Configuration of the camming mechanism enables the connector to be effectively sealed. Simplicity of the terminals make them both cost-effective and reliable.

I claim:

1. An electrical connector comprising an insulative housing and a plurality of terminals mounted therein, the connector comprising a means for biasing contact surfaces of the terminals away from their mated position to a pre-mated position to enable zero insertion force (ZIF) coupling to a complementary connector, wherein the means for biasing the contact surfaces comprises a camming section rotatably mounted to the housing, the camming section having a retracted camming surface close to a pivot axis of the camming section, and a longitudinal camming surface distant from the pivot axis, the connector providing access to an end of the complementary connector for abutment of the end against the camming section; the camming section rotatable from a pre-mated position where the terminal contact surfaces are biased apart to a mated position where the terminals contact the complementary connector, wherein during pivoting of the camming section from the pre-mated to the mated position the longitudinal camming surface abuts the complementary connector end thereby biasing the connectors apart from each other to provide a wiping action between the terminals and complementary connector.

2. The connector of claim 1 wherein the camming section is a single integral part where the camming surfaces act directly on the complementary connector end and terminals.

3. The connector of claim 2 wherein the camming section is positioned between two rows of opposed terminal contact sections.

4. The connector of claim 3 wherein the camming section has a substantially oval profile.

5. The connector of claim 1 wherein the camming section is rotatably supported on either end in cavities at opposed longitudinal ends respectively of the housing.

6. The connector of claim 1 wherein one end of the camming section supports the camming section rotatably to the housing, the end comprising wing members positioned outside of the housing and engageable in a cutout of a shroud of the complementary connector, the wing members extending radially outwards from the support end and arranged such that in the pre-mated condition they are insertable through a mouth portion of the cutout of a mating end of the complementary connector shroud, but once rotated to the mated condition extend further than the width of the mouth portion for locking the connectors together.

7. The connector of claim 6 wherein an O-ring seal member is positioned between the end of the camming section and the housing for sealing therebetween.

8. The connector of claim 1 wherein the terminals comprise a contact section that has a base strip extending from a connection section for connection to a conductor, to a mating end proximate a mating face of the connector, and a resilient contact arm reversely bent therefrom and extending to a free end proximate the connection section, where a contact surface protrudes from the contact arm for contacting terminals of the complementary connector, the contact arm positioned between the free end and contact surface for biasing against the camming section.

9. The connector of claim 8 wherein at least one of the terminals comprises a pair of spaced-apart mirror image contact sections integral with the connection section for higher current applications.

* * * * *